US009702245B1

(12) United States Patent
Dugas

(10) Patent No.: US 9,702,245 B1
(45) Date of Patent: Jul. 11, 2017

(54) FLOW OFF DOWNHOLE COMMUNICATION METHOD AND RELATED SYSTEMS

(71) Applicant: BAKER HUGHES INCORPORATED, Houston, TX (US)

(72) Inventor: Bryan C. Dugas, Breaux Bridge, LA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 15/042,807

(22) Filed: Feb. 12, 2016

(51) Int. Cl.
*E21B 47/18* (2012.01)
*E21B 47/06* (2012.01)
*E21B 41/00* (2006.01)

(52) U.S. Cl.
CPC ..... *E21B 47/18* (2013.01); *E21B 41/0085* (2013.01); *E21B 47/06* (2013.01)

(58) Field of Classification Search
CPC ..... E21B 47/18; E21B 47/187; E21B 47/182; E21B 47/12; E21B 47/185; E21B 47/16; E21B 47/122; E21B 47/14
USPC ..... 367/83
See application file for complete search history.

(56) References Cited

U.S. PATENT DOCUMENTS 5,289,354 A 2/1994 Clayer et al.
5,579,283 A * 11/1996 Owens ..... E21B 23/00 175/40
5,583,827 A 12/1996 Chin
6,172,614 B1 1/2001 Robison et al.
6,384,738 B1 5/2002 Carstensen et al.
6,760,275 B2 7/2004 Carstensen
7,228,902 B2 6/2007 Oppelt
2003/0026167 A1* 2/2003 Hahn ..... E21B 47/18 367/38
2007/0017671 A1* 1/2007 Clark ..... E21B 47/12 166/248
2013/0249703 A1* 9/2013 Hawthorn ..... E21B 17/028 340/854.3
2014/0354444 A1* 12/2014 Whitacre ..... E21B 47/18 340/854.3
2015/0377018 A1* 12/2015 Lee ..... E21B 47/182 340/854.3

OTHER PUBLICATIONS

Tubel, P. et al., "Mud Pulser Telemetry System for Down Hole Measurement-While-Drilling".

* cited by examiner

*Primary Examiner* — Mark Blouin
(74) *Attorney, Agent, or Firm* — Mossman, Kumar & Tyler, PC

(57) ABSTRACT

A method enables communication with downhole tools during a "flow off" condition by energizing at least one sensor and a controller using a local power source only after flow of drilling fluid has been reduced below the threshold flow rate value. Thereafter, the method involves generating the at least one predetermined pattern into the wellbore, detecting the at least one predetermined pattern using the at least one sensor and the controller, and transmitting a signal using the controller in response to the detected at least one predetermined pattern.

16 Claims, 2 Drawing Sheets

FLOW OFF DOWNHOLE COMMUNICATION METHOD AND RELATED SYSTEMS

1. Field of the Disclosure

This disclosure relates generally to oilfield systems for communicating with downhole tools.

2. Background of the Art

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. A suitable drilling fluid (commonly referred to as the "mud") is supplied or pumped under pressure from a source at the surface down the tubing. The drilling fluid may drive a motor and then exit at the bottom of the drill bit. The drilling fluid returns uphole via the annulus between the drill string and the wellbore inside and carries with it pieces of formation cut by the drill bit in drilling the wellbore. In many instances, surface communication with downhole tools is necessary for efficient drilling activity. This communication is often enabled by energizing communication devices using electrical power generated using turbines or other rotary devices that harness the energy in the circulating drilling fluid. Therefore, interruptions to fluid circulation can disrupt communication.

The present disclosure addresses the need to communicate with downhole tools in situations where locally generated electrical power is not available to energize downhole communication devices.

SUMMARY OF THE DISCLOSURE

In aspects, the present disclosure provides a communication method used in connection with wellbore related activities. The method includes connecting at least one sensor and a local power source to a controller, programming at least one predetermined pattern into the controller; positioning the at least one sensor, the controller, and the local power source along a bottomhole assembly; and conveying the bottomhole assembly into a wellbore. The predetermined pattern is based on a parameter of interest estimated by the at least one sensor. The method also includes the steps of generating power at the bottomhole assembly using a generator energized by a drilling fluid flowing at at least a threshold flow rate value; and reducing the flow of the drilling fluid below the threshold value to terminate the generation of power at the bottomhole assembly. Communication is enabled by energizing the at least one sensor and the controller using the local power source only after the flow of the drilling fluid has been reduced below the threshold flow rate value; generating the at least one predetermined pattern into the wellbore; detecting the at least one predetermined pattern using the at least one sensor and the controller; and transmitting a signal using the controller in response to the detected at least one predetermined pattern.

In aspects, the present disclosure further provides a method of communication between a surface location and a bottomhole assembly configured for use in a wellbore. The method may include configuring the bottomhole assembly to having a fluid energized electric power generator and a sensor sub, wherein the sensor sub includes at least one pressure sensor and a controller selectively energized by a local power source, wherein the controller is programmed with at least one predetermined pressure pattern; conveying the bottomhole assembly into a wellbore; circulating fluid above a threshold flow rate in order to energize the electric power generator; drilling the wellbore using the bottomhole assembly; terminating the drilling activity and reducing the fluid circulation below the threshold flow rate, thereby terminating the generation of electrical power at the bottomhole assembly; energizing the at least one sensor and the controller using power stored in the local power source only after the flow of the drilling fluid has been reduced below the threshold flow rate value; generating the at least one predetermined pressure pattern in the wellbore; detecting the at least one predetermined pattern using the at least one sensor and the controller; using the programmed at least one predetermined pressure pattern to select an action using the controller; and transmitting a signal associated with the action using the controller.

In aspects, the present disclosure provides a system for communicating between a surface location and a bottomhole assembly in a wellbore. The system may include a fluid energized electric power generator in the bottomhole assembly and configured to generate electrical power after fluid circulation reaches a threshold flow rate; a sensor sub in the bottomhole assembly, the sensor sub including at least one sensor and a controller, the at least one sensor and the controller being energized by a local power source after the fluid circulation falls below the threshold flow rate, wherein the controller is programmed with at least one predetermined pattern, the controller being further programmed to: (i) detect the at least one predetermined pattern using the at least one sensor after the fluid circulation falls below the threshold flow rate, (ii) select an action based on the programmed at least one predetermined pattern, and (iii) and transmit a signal associated with the action.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the preferred embodiment, taken in conjunction with the accompanying drawing.

DETAILED DESCRIPTION OF THE DISCLOSURE

Figure 1:
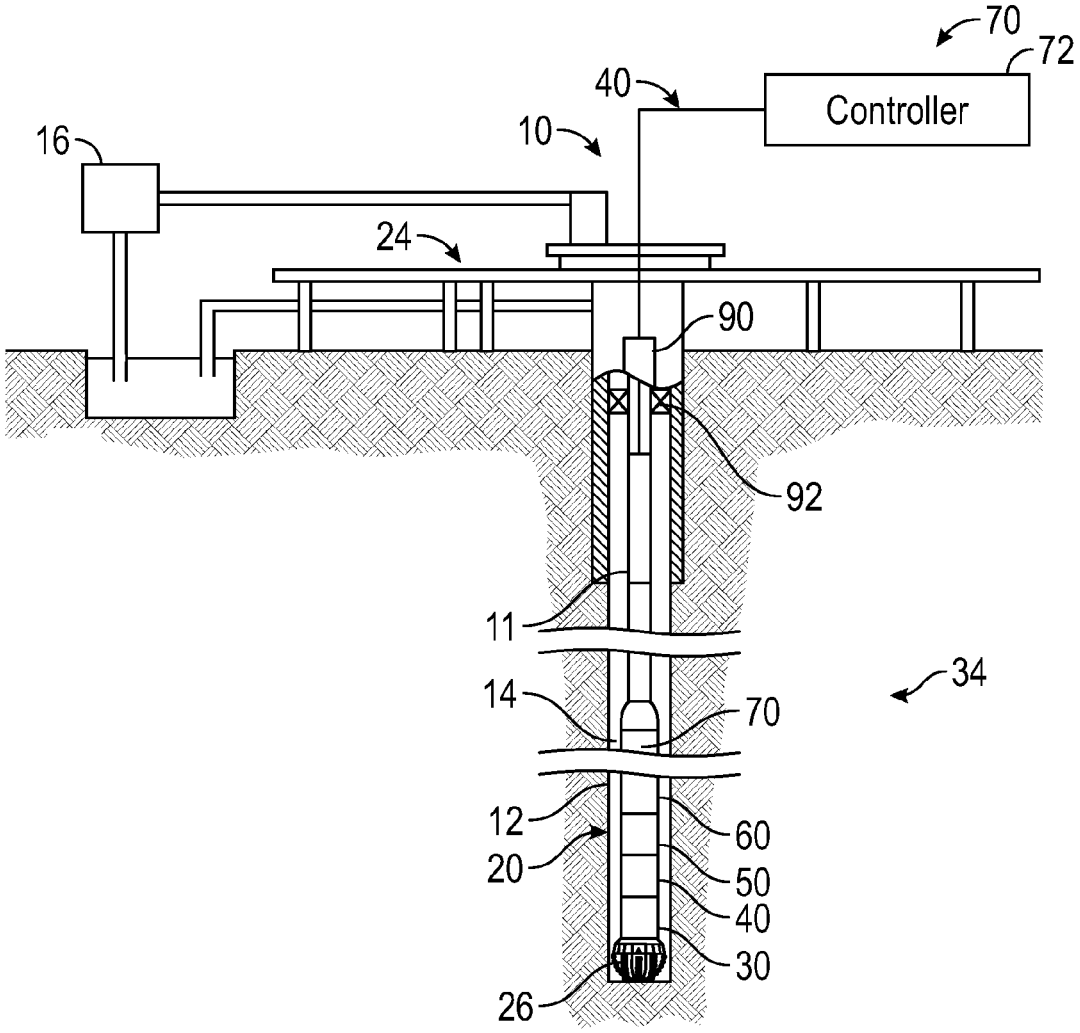
FIG. 1 is a schematic illustration of one embodiment of a drilling system that may incorporate a communication system according to embodiments of the present disclosure.

Referring initially to FIG. 1, there is schematically illustrated an elevation view of a system 10 for the construction, logging, completion or work-over of a wellbore 12. The system 10 includes a drill string 11 and a bottomhole assembly (BHA) 20. In one embodiment, the drill string 11 may be made up of a section of rigid tubulars (e.g., jointed tubular). The drill string 11 may be rotated by a top drive 24 or other suitable rotary power device. In one embodiment, the BHA 20 includes a drill bit 26, a steering unit 30, a drilling motor 40, a sensor sub 50, a bidirectional communication and power module (BCPM) 60, and a formation evaluation (FE) sub 70. The BCPM 60 may include an electrical power generator, e.g., a mud turbine, (not shown) that generates electrical power when there is a threshold fluid flow rate through the BHA 20. In some embodiments, the BCPM may be configured to transmit back to surface a command, parameter, or other encoded signal that was downlinked from surface.

One conventional method of establishing communication uplinks and downlinks is through pressure pulses transmitted via the fluid column in the wellbore 12. The fluid column can be in a bore 18 (FIG. 2) of the drill string 11 and/or the fluid column in an annulus 14 surrounding the drill string 11. Typically, these pressure pulses are generated by increasing fluid flow, by restricting fluid flow, and/or generating a backpressure. Valve, chokes, flow bypasses, and other flow devices may be used for such purposes. These devices may be manually or computer controlled.

Communication between the surface and the BHA 20 require the BCPM 60 to be operating and generating electrical power. However, as noted above, the BCPM 60 is energized by fluid circulation at or above a minimum/threshold flow rate. Fluid circulation below the threshold flow rate can lead to interruptions in communication between the BHA 60 and the surface. Such interruptions can occur in a number of situations. For instance, adding or removing pipe joints to the drill string 11 can require surface pumps 16 to be stopped, which then stops fluid circulation in the wellbore 12. Once fluid circulation falls before the threshold level, the BCPM 60 stops generating electricity. Embodiments of the present disclosure enable communication between the surface and the BHA 20 despite the BCPM 60 being non-functional in such situations.

Figure 2:
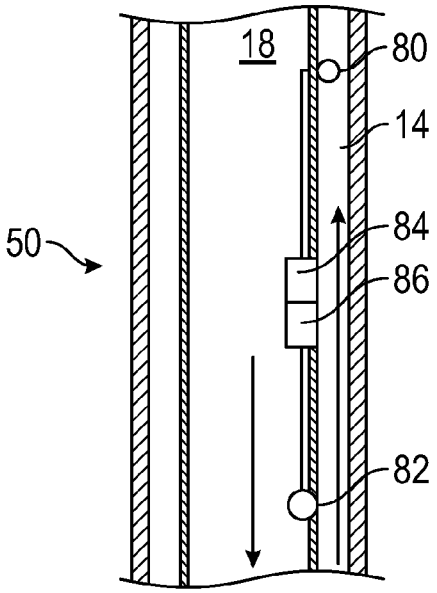
FIG. 2 schematically illustrates a locally energized pressure sensor arrangement according to one embodiment of the present disclosure.

Referring to FIG. 2, there is shown a section of the sensor sub 50 in accordance with one embodiment of the present disclosure. The sensor sub 50 includes at least one external pressure sensor 80, at least one internal pressure sensor 82, a control unit 84, and a local power source 86. The external pressure sensor 80 estimates the pressure in the annulus 14 and the internal pressure sensor 82 estimates the fluid pressure in a bore 18 of the sensor sub 50. The control unit 84 includes wiring, circuitry, microprocessors, memory, algorithms, and other known equipment needed to acquire, store, and transmit information obtained from the pressure sensors 80, 82. The local power source 86, such as a battery, provides stored power to the control unit 84 when power is not received from BCPM 60. While two sensors 80, 82 are shown, other embodiments may use only one sensor or three or more sensors. Also, as discussed later, some embodiments of the present disclosure may use other sensors, such as motion sensors.

Referring to FIGS. 1 and 2, in a first mode of operation, communication with the BHA 20 can be established by translating the drill string 11 in the borehole a specified distance. Hydrostatic pressure varies directly with depth in a vertical borehole. Thus, by sliding the drill string 11 uphole or downhole a specified amount, the pressure applied to the pressure sensors 80, 82 can be changed. By using parameters such as mud weight, a pressure change per unit of distance can be determined. Once the pressure change per unit distance is determined, the drill string 11 can be shifted the necessary amount in order to expose the pressure sensors 80, 82 to a desired pressure change.

One methodology employing the pressure changes includes constructing a codex that consists of one or more pressure patterns. The patterns may be shaped by amplitude, frequency, duration, and quiet periods. Purely by way of example, a pattern may consist of three pressure changes of seventy-five PSI over a duration of one minute, a thirty second quiet period, and four pressure changes of seventy-five PSI over a duration of one minute. A codex of such patterns may be programmed in the controller 84. Thereafter, the controller 84, once energized by the local power source 86, monitors the pressure readings of the pressure sensors 80, 82 for these patterns. These patterns can be generated by displacing or sliding the drill string 11 using surface equipment which alters the downhole position of the BHA 20 connected to the drill string 11.

The predetermined codex programmed into the controller 84 can consist of several types of signals. One signal may be to instruct the controller 84 enter or exit a "listen" mode. The "listen" mode may be a period of time wherein information is transmitted to the BHA 20 and the controller 84 is responsive to detected predetermined patterns. During the "listen" mode, the controller 84 may detect patterns that instruct the controller 84 to activate or deactivate downhole tooling, signals that reprogram operating set points of equipment, or perform other functions in response.

Referring to FIG. 1, in a second mode of operation, communication with the BHA 20 can also be established by changing a pressure in the fluid column in the borehole 12. For example, the hydrostatic pressure in the fluid column in the wellbore 12 can be varied by using a pressure applicator 90 that applies pressure to the fluid in the drill string 11 and a flow control device 92 to control the flow of fluid in the wellbore annulus 14. The pressure applicator 90 may be a plunger, piston, or other device that can press down on the fluid column to increase pressure. The flow control device 92 may be a choke, valve, or other device that can control the back pressure in the wellbore 12. It should be appreciated that by increasing/decreasing the pressure by operating the pressure application 90 and/or the flow control device 92, a predetermined pressure pattern can be effectively transmitted to the BHA 20.

In a third mode of operation, fluid circulation can be modulated to generate a predetermined pressure pattern for communicating with the BHA 20. It should be understood that fluid circulation can still occur after the BPCM 60 stops generating electricity due to insufficient fluid flow rates. Thus, after the BHA 20 enters a "flow off" condition, a fluid circulation can still exist and can be manipulated in order to transmit pressure signals to the pressure sensors 80, 82, which are operating under battery power.

Figure 3:
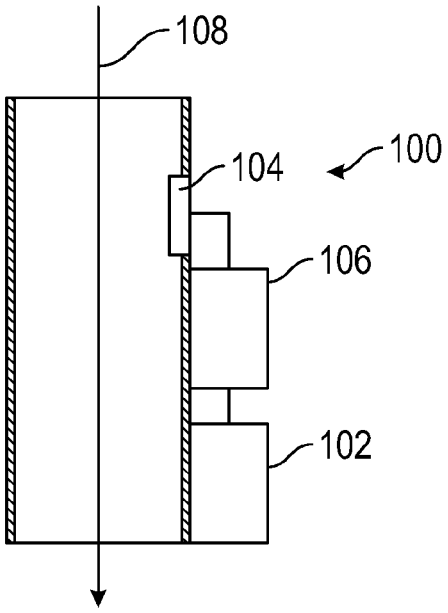
FIG. 3 schematically illustrates a triggering device according to one embodiment of the present disclosure.

Referring to FIG. 3, there is shown another arrangement according to the present disclosure wherein a triggering device 100 is used to control operation of selected downhole tool 102. The triggering device 100 may include a flow sensor 104 and a controller 106. The flow sensor 104 may include a pressure transducer, such as a piezoelectric element, that is configured to detect fluid flow 108. While the fluid flow 108 is shown in a bore 110, the fluid flow may also occur outside of the tool 100. As discussed previously, the fluid flow 108 can be modulated to vary one or more parameters according to a predetermined pattern that is programmed into the controller 106.

The controller 134 may be programmed with a codex, or a set of predetermined patterns, as discussed previous. For instance, a detected predetermined pattern may instruct the controller 134 to "wake" from a low power or "sleep" state and send a signal to the separate tool 102. Thus, the predetermined pattern, or signal, may be a simple command such as to activate or deactivate. The signal may also be more complex and include operating parameters, queries, and other types of information. The selected downhole tool 102 may be any device making up the BHA, such as a formation evaluation tool, steering tool, communication device, etc.

It should be appreciated that the teachings of the present disclosure may allow downlinks to continue in "flow off" conditions that would otherwise prevent such communications. By way of example, during drilling, pumps may be secured in order to add a pipe joint. The BCPM 60 stops generating power, which then initiates operation of the sensor sub 60 using locally stored power. While that joint is being added, downlinks may be sent in any of the ways described above to the BHA 20. The sensor sub 60 responds to these downlinks by taking any number of actions (e.g., starting/stopping actions, reprogramming tooling with different operating set points, recording information, etc.). Once fluid circulation is reestablished the BCPM 60 can resume communication duties. If configured to do so, the BCPM 60 can transmit back to surface a command, parameter, or other encoded signal that was downlinked from surface while flow was below the threshold flow rate. Alternatively or additionally, changes in surface measurements (weight, torque, pressure, etc.) can be monitored to verify downlinks for downlink-only applications which do not have a closed-looped downhole uplink communications capability.

The above description uses pressure sensors as an example of a downhole sensor that may be locally powered and used as a communication device. It should be understood that any number of sensors, such as accelerometers or motion sensors, that are locally powered can be used in lieu of or in conjunction with pressure sensors. Such sensor may be used to detect drill string motion such as rotation, counter-rotation, sliding uphole, or sliding downhole.

Also, it should be understood that the teachings of the present disclosure are not limited to only the drilling environment or system shown in FIG. 1. For instance, the teachings of the present disclosure may be used in offshore rigs as well as land wells. Also, while a rigid jointed tubular has been described, some embodiments may be used in conjunction with a drill string that includes a non-rigid tubular such as coiled tubing. In still other applications, the present teachings may be used in non-drilling operations such as well completion and production. That is, the use of modulated flow parameters (pressure or flow rates) may be used to communication with locally powered downhole tools used after drilling has been completed.

A controller or control as described above may be nay information processing device that transmits, receives, manipulates, converts, calculates, modulates, transposes, stores or otherwise utilizes information. In several non-limiting aspects of the disclosure, an information processing device may include a computer or microprocessor that executes programmed instructions.

While the foregoing disclosure is directed to certain embodiments of the disclosure, various modifications will be apparent to those skilled in the art. It is intended that all variations within the scope of the appended claims be embraced by the foregoing disclosure.

What is claimed is:

1. A communication method, comprising:
- connecting at least one sensor and a local power source to a controller, the at least one sensor being configured to estimate a selected parameter;
- programming at least one predetermined pattern based on the selected parameter into the controller;
- positioning the at least one sensor, the controller, and the local power source along a bottomhole assembly;
- conveying the bottomhole assembly into a wellbore;
- generating power at the bottomhole assembly using a generator energized by a drilling fluid flowing at at least a threshold flow rate value;
- reducing the flow rate of the drilling fluid below the threshold value to terminate the generation of power at the bottomhole assembly;
- energizing the at least one sensor and the controller using power stored in the local power source only after the flow of the drilling fluid has been reduced below the threshold flow rate value;
- generating the at least one predetermined pattern in the wellbore;
- detecting the at least one predetermined pattern using the at least one sensor and the controller; and
- transmitting a signal using the controller in response to the detected at least one predetermined pattern.

2. The communication method of claim 1, wherein the selected parameter is pressure and the at least one sensor is a pressure sensor.

3. The communication method of claim 2, further comprising displacing the bottomhole assembly a predetermined distance in order to generate the at least one predetermined pattern.

4. The communication method of claim 3, wherein the predetermined pattern includes at least one change in pressure while there is no fluid flow through the bottomhole assembly.

5. The communication method of claim 4, further comprising determining the at least one change in pressure by using a density of the drilling fluid.

6. The communication method of claim 2, further comprising varying a flow rate of the drilling fluid in order to generate the at least one predetermined pattern, wherein the flow rate is always below the threshold flow rate value.

7. The communication method of claim 2, further comprising varying the hydrostatic pressure of the fluid column in order to generate the at least one predetermined pattern.

8. The communication method of claim 1, wherein the at least one predetermined pattern is only generated while the drilling fluid is flowing at below the threshold flow rate value.

9. A method of communication between a surface location and a bottomhole assembly configured for use in a wellbore, comprising:
- configuring the bottomhole assembly to having a fluid energized electric power generator and a sensor sub, wherein the sensor sub includes at least one pressure sensor and a controller selectively energized by a local power source, wherein the controller is programmed with at least one predetermined pressure pattern;
- conveying the bottomhole assembly into a wellbore;
- circulating fluid above a threshold flow rate in order to energize the electric power generator;
- drilling the wellbore using the bottomhole assembly;
- terminating the drilling activity and reducing the fluid circulation below the threshold flow rate, thereby terminating the generation of electrical power at the bottomhole assembly;
- energizing the at least one sensor and the controller using power stored in the local power source only after the flow of the drilling fluid has been reduced below the threshold flow rate value;
- generating the at least one predetermined pressure pattern in the wellbore;
- detecting the at least one predetermined pattern using the at least one sensor and the controller;

using the programmed at least one predetermined pressure pattern to select an action using the controller; and transmitting a signal associated with the action using the controller.

10. The communication method of claim 9, wherein there is no fluid flow through the bottomhole assembly while generating the at least one predetermined pressure pattern in the wellbore.

11. The communication method of claim 10, further comprising displacing the bottomhole assembly a predetermined distance along the wellbore in order to generate the at least one predetermined pressure pattern.

12. The communication method of claim 10, further comprising varying the hydrostatic pressure of the fluid column in order to generate the at least one predetermined pattern.

13. The communication method of claim 9, wherein the at least one predetermined pressure pattern is only generated while the drilling fluid is flowing at below the threshold flow rate value.

14. The communication method of claim 13, further comprising varying a flow rate of the drilling fluid in order to generate the at least one predetermined pattern.

15. A system for communicating between a surface location and a bottomhole assembly in a wellbore, comprising:

a fluid energized electric power generator in the bottomhole assembly and configured to generate electrical power after fluid circulation reaches a threshold flow rate;

a sensor sub in the bottomhole assembly, the sensor sub including at least one sensor and a controller, the at least one sensor and the controller being energized by a local power source after the fluid circulation falls below the threshold flow rate, wherein the controller is programmed with at least one predetermined pattern, the controller being further programmed to: (i) detect the at least one predetermined pattern using the at least one sensor after the fluid circulation falls below the threshold flow rate, (ii) select an action based on the programmed at least one predetermined pattern, and (iii) and transmit a signal associated with the action.

16. The system of claim 15, wherein the at least one sensor is a pressure sensor and the at least one predetermined pattern includes a pressure pattern.

* * * * *